United States Patent [19]

Pinto et al.

[11] Patent Number: 4,774,758

[45] Date of Patent: Oct. 4, 1988

[54] APPARATUS FOR OPENING PRESSED FIBER BALES BY A REDUCING DEVICE

[75] Inventors: Akiva Pinto, Gastonia, N.C.; Gunter Lucapen, Haltern; Reinhard Schmidt, Gescher, both of Fed. Rep. of Germany

[73] Assignee: Hergeth Hollingsworth GmbH, Duelmen, Fed. Rep. of Germany

[21] Appl. No.: 56,186

[22] Filed: May 27, 1987

[30] Foreign Application Priority Data

Jul. 9, 1986 [DE] Fed. Rep. of Germany ..... 3622977

[51] Int. Cl.[4] ..... B23P 21/00; B02C 25/00

[52] U.S. Cl. ..... 29/714; 29/707; 241/37

[58] Field of Search ..... 29/707, 708, 709, 714; 241/33, 34, 37

[56] References Cited

U.S. PATENT DOCUMENTS

| | | | |
|---|---|---|---|
| 3,078,051 | 2/1963 | Patterson | 241/37 X |
| 3,529,778 | 9/1970 | Willman | 241/37 X |
| 3,591,094 | 7/1971 | Gauer | 241/37 |
| 4,295,614 | 10/1981 | Bond, III | 241/37 X |

*Primary Examiner*—Timothy V. Eley
*Attorney, Agent, or Firm*—Cort Flint

[57] ABSTRACT

Apparatus for opening compressed bales of fiber includes means for supporting one or more of said compressed bales of fiber in a row. A reciprocating tower is provided and supported for reciprocating alongside the row of said bales of fiber and has a cantilevered portion which extends over the row of bales of fiber at a height which is adjustable. Reducing means is supported by the cantilevered portion over the top surface of the bales for removing fiber therefrom. A horizontal channel is disposed adjacent to and above the reducing means for receiving fiber removed from the bale by the reducing means. The horizontal channel is connected to a telescoping vertical channel within the tower means for delivering fiber from the reducing means to the discharge channel in the tower when a suction force is created therein. A scanning means is provided for measuring the density of fiber within the horizontal and vertical channel and for generating a signal which corresponds to the density of the fiber measured in the channel and a control means is provided for receiving the signal generated by the scanning means and for adjusting the height of the cantilevered portion so as to maintain a predetermined fiber density within the channels. The scanning means may comprise a light barrier arrangement or an ultrasonic means.

13 Claims, 1 Drawing Sheet

APPARATUS FOR OPENING PRESSED FIBER BALES BY A REDUCING DEVICE

BACKGROUND OF THE INVENTION

The invention relates to an apparatus for opening compressed fiber bales, e.g. of cotton, synthetic fibers, etc., by a reducing device which is adjustable in height for guiding it over the surface of the compressed bale or row of compressed bales to be worked, the distance to be maintained over the bale surface or the advance of the removing device being controlled by a scanning means.

The adjustment in height of the reducing device with respect to the surface of the compressed bale to be worked is realized in different ways. It is, for example, possible to scan the height of the set up bales by manual adjustment. The corresponding height value is stored in a microcomputer, and the automatic setting of the predetermined depth of removal is controlled individually per group of bales in case of each reducing pass.

Further, it has been known to use as scanning means individual rods of the grid through which operate milling disks of a milling roller and which rests on the compressed bale surface to be reduced, so that, upon a contact of the scanning rod with the surface of the bale, the lowering movement of the reducing device is stopped, whereupon its operational advance may be performed.

According to another embodiment, the bale height is scanned by sensors which are disposed outside the reducing device and more or less at the underside of the reducer housing. The sensors scan the distance of the reducer housing from the bale surface to be removed. If the reducing device has reached the bale surface, the lowering advance thereof is stopped by respective control means.

It is very seldom that the surface to be worked of the set up compressed bale or of the bales is a plane, or of even height, but usually, it is considerably varying in height, in particular, if the pressure from the banded bales is released. Subject to the intensity of the precedingly exerted pressure, the aspect of the top surface of the bales is different, and this is also true for the situation inside the bale surface. In case of the known scanning means used for scanning the height of the bale surface under treatment, mis-scanning by the influence of a so-called apparent height of the bale surface to be worked cannot be excluded.

SUMMARY OF THE INVENTION

It is the object of the invention to provide a safer and more reliable scanning of the bale height. This is really decisive for the reducing operation, i.e. of the bale surface to be worked. The invention is characterized in that the current of discharged material is checked by the scanning means, e.g. by its arrangement at the discharge channel for the removed material.

Due to such a scanning means design, scanning is performed by measuring the material removed. The extent of material removed, i.e., the quantity throughput of removed material is the correcting element for the control of the scanning means. By scanning the amount of removed material, it is reliably ensured that the bale height has been reached for the start of the working operation. No irritation due to apparent heights is possible any longer. If the material flow or current is too low, the reducing device, due to the scanning means, is further lowered to the bale surface to be worked. If, on the other hand, during the reducing operation, the discharge channel is clogged with material thus affecting the scanning operation, the reducing or removing means is automatically lifted from the surface to be worked so that less material is fed to eliminate clogging.

The scanning means may be a light barrier assembly of such a design that the height adjustment of the reducing device comes to a standstill within a specific range of light density of removed fibers, flocks, etc.

In case of an opening means comprising a tower displaceable along a row of bales and having a cantilevered portion containing a milling device, wherein the removed fibers, flocks, etc., are carried away pneumatically by suction through the cantilevered portion and the tower, the scanning means is provided in the suction channel for the pneumatically removed material. It is advantageous, in this embodiment, to mount the scanning means at the point of transfer of the suction channel to the discharge channel and the tower. Thus, the total material carried by the air current may be determined at one point. Further, with respect to the material removal, scanning is performed at an earlier moment, thus ensuring a quick reaction and correction.

Scanning of the removed material may be also performed in a different way, for example, by ultrasonic means. Furthermore, a number of scanning means may be distributed over the length of the milling device above the milling roller in the suction channel and the values detected by the light barrier scanning may be integrated by a control means to obtain one decisive value.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF THE DRAWINGS

Figure 1:
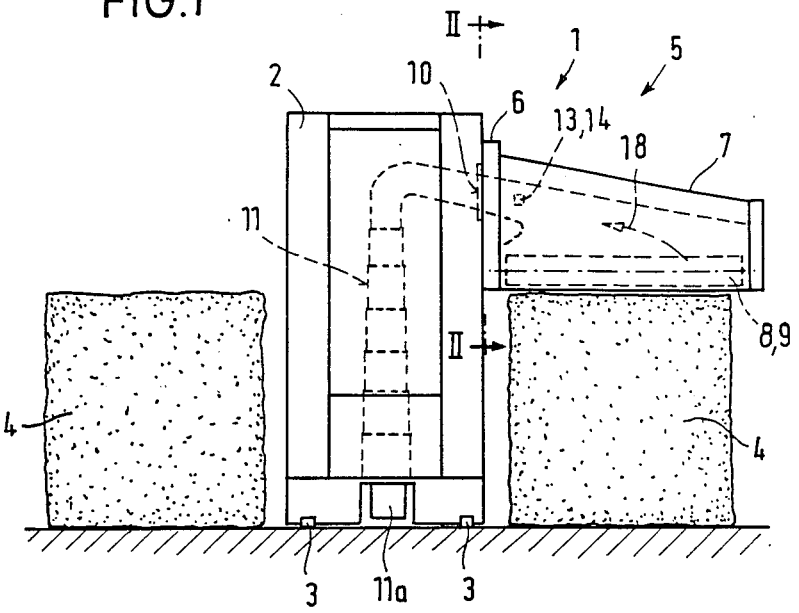
FIG. 1 is an elevational schematic view of an embodiment of an opening means of the invention, in connection with a reducing device with a pneumatic discharge of material.
Figure 2:
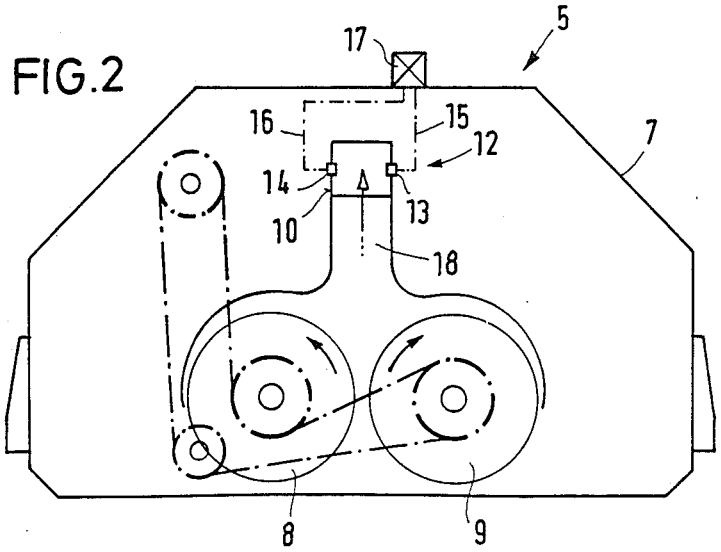
FIG. 2 is a sectional view taken along line II—II of FIG. 1, enlarged and viewed schematically.

In the illustrated embodiment, the opening means for a compressed bale or a row of bales 4 comprises a tower 2 reciprocating on rails 3 along side the bale row 4, said tower 3 being provided with a cantilevered portion 5 which is mounted at one side of the tower 2 by a flange housing 6. A milling means accommodated in the cantilevered housing 7 consists of two milling rollers 8 and 9 which rotate upwardly in opposite directions toward the center of the roller pair, and which remove from the top of the bale row 4 fibers or flocks or the like to throw them upwardly intermediate the rollers. By a pneumatic suction current, the removed fibers are drawn through a connecting piece 10 into the interior of tower 2, in which a telescopic guide 11 extends to a lower collection channel 11*a* extending longitudinally. With a progressive decrease of the compressed bale height, the cantilevered portion 5 is lowered accordingly.

The scanning means used for adjusting the working height of the milling device 8, 9 or of the housing 7 accommodating the milling device, is for example, a light barrier assembly 12, which consists of a light emitter 13 and of a light-reactive cell, for example, a selenium cell 14. Emitter 13 and receiver 14 are connected by control lines 15 and 16 to a circuit unit 17, e.g. a switching relay system. Such a light barrier scanning means is provided at the discharge channel 18, i.e. the suction channel, for the removed material. Advantageously, it is mounted near the point of transfer of the suction channel 18 to the discharge channel 11 in advance of piece 10. At this point, all removed fibers and flocks are combined to one current. The material thrown over the length of the milling device 8, 9 and further conveyed by suction is united at said point. The control of the scanning means in the form of a light barrier assembly, is controlled by the discharged material. It is possible to provide at this point a number of light emitters and receivers whose switching relay may be adjusted to a corresponding predetermined density of the material current. If the switching relay is set to a predetermined amount of throughput, the switching of the up and down movement of the milling device is realized by the housing. Thus, a constant density of material current is ensured during the removing or reducing operation.

Further, the scanning points may be distributed over the length of housing 7, and if so, all the value detected over the length of the milling device concerning the absorbed individual currents of fibers or flocks are integrated electrically. The determined total value forms the correcting element for the movement of the advance of the reducing means 5 in height direction.

What is claimed is:

1. Apparatus for opening compressed bales of fiber, comprising:

(a) means to support one or more compressed bales of fiber;

(b) a tower disposed for reciprocation alongside said bale support;

(c) a cantilevered portion of said tower extending over said bales of fiber at a height which is adjustable;

(d) a reducing means supported by said cantilevered portion for removing fiber from the top surface of said bales;

(e) channel means disposed adjacent to said reducing means for receiving fiber removed from said bales;

(f) means for creating suction within said channel for drawing said fiber into said channel;

(g) scanning means for measuring the density of fiber within said channel and for generating a signal corresponding to the density of fiber measured in said channel; and (h) control means for receiving the signal generated by said scanning means and for adjusting the height of said cantilevered portion to maintain a predetermined fiber density within said channel.

2. Apparatus for opening compressed bales of fiber as set forth in claim 1, wherein said scanning means is disposed within said channel above said reducing means.

3. Apparatus for opening compressed bales of fiber as set forth in claim 1, wherein said scanning means comprises a light barrier arrangement disposed within said channel.

4. Apparatus for opening compressed bales of fiber as set forth in claim 1, wherein said scanning means measures the density of the fibers within said channel by ultrasonic means.

5. Apparatus for opening compressed bales of fiber as set forth in claim 1, wherein said scanning means comprises a plurality of detectors for detecting the fiber density at a plurality of points.

6. Apparatus for opening compressed bales of fiber as set forth in claim 5, wherein said plurality of detectors generate a plurality of signals and said control means comprises means for integrating said signals into a common controlled signal corresponding to the overall density of fiber within said channel.

7. Apparatus for opening compressed bales of fiber, comprising:

(a) means to support a plurality of bales of fiber;

(b) a tower mounted for reciprocation alongside the bale support means;

(c) a cantilevered portion of said tower extending over said bales of fiber at a height which is adjustable;

(d) a reducing means comprising two milling rollers supported by said cantilevered portion for removing fiber from the top surfaces of said bales;

(e) horizontal channel means disposed above said milling rollers for receiving fibers removed from said bales;

(f) a telescoping vertical discharge channel disposed within said tower and connected to said horizontal channel for receiving fiber from said horizontal channel;

(g) means for creating suction within said vertical and said horizontal channels for drawing fiber into, and through, said channels;

(h) scanning means for measuring the density of fiber within one of said channels and for generating a signal corresponding to the density of fiber measured in said channel; and (i) control means for receiving the signals generated by said scanning means and for adjusting the height of said cantilevered portion relative to the said tower and the upper surfaces of said bales so as to provide a predetermined fiber density within said channel.

8. Apparatus for opening compressed bales of fiber as set forth in claim 7, wherein said scanning means is disposed within said horizontal channel above said reducing means.

9. Apparatus for opening compressed bales of fiber as set forth in claim 7, wherein said scanning means comprises a light barrier arrangement disposed within said channel.

10. Apparatus for opening compressed bales of fiber as set forth in claim 7, wherein said scanning means measures the density of the fibers within said channel by ultrasonic means.

11. Apparatus for opening compressed bales of fiber as set forth in claim 7, wherein said scanning means comprises a plurality of detectors for detecting the fiber density at plurality of points.

12. Apparatus for opening compressed bales of fiber as set forth in claim 11, wherein said plurality of detectors generate a plurality of signals and said control means comprises means for integrating said signals into a common control signal corresponding to the overall density of fiber within said channel.

13. Apparatus for opening compressed bales of fiber of the type which includes means to support one or more compressed bales of fiber; a tower disposed for reciprocation alongside said bale support; a cantilevered portion of said tower extending over said bales of fiber at a height which is adjustable; a reducing means supported by said cantilevered portion for removing fiber from the top surface of said bales; channel means disposed adjacent to said reducing means for receiving fiber removed from said bales including a discharge channel for conveying fiber away from said cantilevered portion; and means for creating suction within said channel for drawing said fiber into said channel; wherein said apparatus comprises scanning means disposed adjacent to said discharge channel for measuring the density of fiber within said channel and for generating a signal corresponding to the density of fiber measured in said channel; and control means for receiving the signal generated by said scanning means and for adjusting the height of said cantilevered portion to maintain a predetermined fiber density within said channel.

* * * * *